US011732457B2

(12) United States Patent
Geldenhuis

(10) Patent No.: US 11,732,457 B2
(45) Date of Patent: Aug. 22, 2023

(54) WATER INFILTRATION CONDUIT

(71) Applicant: Pieter Geldenhuis, Queensland (AU)

(72) Inventor: Pieter Geldenhuis, Queensland (AU)

( * ) Notice: Subject to any disclaimer, the term of this patent is extended or adjusted under 35 U.S.C. 154(b) by 22 days.

(21) Appl. No.: 17/462,415

(22) Filed: Aug. 31, 2021

(65) Prior Publication Data

US 2023/0061601 A1 Mar. 2, 2023

(51) Int. Cl.
*E03F 1/00* (2006.01)
*E03F 5/04* (2006.01)

(52) U.S. Cl.
CPC ..... *E03F 1/003* (2013.01); *E03F 5/04* (2013.01)

(58) Field of Classification Search
CPC ..... E03F 1/002; E03F 1/003
USPC ..... 405/43, 44, 45, 47, 49
See application file for complete search history.

(56) References Cited

U.S. PATENT DOCUMENTS 640,077 A * 12/1899 Bagby ..... E02B 11/005 405/47
2,366,522 A 1/1945 Gutman
2,866,319 A * 12/1958 Nicholson ..... E03F 1/003 210/322
3,645,100 A 2/1972 La Monica
4,192,628 A 3/1980 Gorman
4,293,237 A * 10/1981 Robey ..... E02B 11/00 405/51
5,017,041 A * 5/1991 Nichols ..... E02B 13/00 403/345
5,419,838 A 5/1995 DiTullio
5,556,231 A * 9/1996 Sidaway ..... E03F 1/003 405/48
5,921,711 A * 7/1999 Sipaila ..... E03F 1/003 405/45

(Continued)

FOREIGN PATENT DOCUMENTS

WO 1980002854 A1 12/1980
WO 2015069098 A1 5/2015

*Primary Examiner* — Frederick L Lagman
(74) *Attorney, Agent, or Firm* — Studebaker & Brackett PC

(57) ABSTRACT

In one aspect the present invention provides an adjustable head infiltration conduit configured to distribute water adjacent to the conduit and to convey water away from the conduit. This conduit includes a conveyance chamber defining a water flow path through the conduit, and at least one inlet port associated with one end of the water flow path defined by the conveyance chamber. Also provided is at least one outlet port associated with an end of the water flow path distal from said at least one inlet port, and an infiltration chamber in fluid communication with the conveyance chamber. This infiltration chamber includes at least one water permeable area configured to allow water out of the conduit. The infiltration chamber also includes at least one removable intermediate lateral baffle orientated substantially perpendicular to the water flow path defined by the conveyance chamber with the upper edge of said at least one removable intermediate lateral baffle defining the boundary of the infiltration chamber with the conveyance chamber. The removable intermediate lateral baffle or baffles forming at least two retention cells within the infiltration chamber arranged to temporarily store water before dispersal through at least one water permeable surface of the infiltration chamber.

17 Claims, 6 Drawing Sheets

(56) References Cited

U.S. PATENT DOCUMENTS

| | | | | |
|---|---|---|---|---|
| 6,821,424 | B1 * | 11/2004 | Branz | C02F 1/006 210/151 |
| 7,300,577 | B1 * | 11/2007 | Branz | C02F 3/046 210/170.08 |
| 8,632,273 | B2 * | 1/2014 | Leung | E01F 5/00 405/47 |
| 2004/0184884 | A1 * | 9/2004 | DiTullio | E03F 1/003 138/121 |
| 2007/0264082 | A1 * | 11/2007 | Burnes | E03F 1/003 405/46 |

* cited by examiner 1
9
10
8
2

10
7
9
3
8
2

2
9
3
1

9
11
4
11
4
5
8
11

WATER INFILTRATION CONDUIT

FIELD OF THE INVENTION

This invention relates to improvements in respect of the management, and in particular the transport and dispersal of water. In preferred aspects the invention may provide a water infiltration conduit configured to distribute water adjacent to the conduit as well as convey water away from the conduit.

BACKGROUND OF THE INVENTION

Storm water and groundwater management is an important consideration in the construction industry. New building work covers land with water impermeable materials such as concrete or asphalt, interrupting natural water infiltration processes.

Various structures have been developed to mitigate problems caused by the interruption of these natural water dispersal processes, aiming to manage storm water flows occurring during rainfall or flooding events.

For example in the case of new housing developments it is common for a soaking trench to be dug to a depth of 1 to 2 metres. These soaking trenches are normally filled with a porous support matrix and then backfilled to provide an underground space for surface water to drain into.

Soakage trenches add to the construction costs of a new building, requiring relatively deep trenches to be dug in areas which may have constricted access. These trenches also require the removal of relatively large volumes of excavated material. Soakage trenches are unable to be constructed in high ground water levels sites as they are deep and require cover material overtop. These issues are exacerbated when the site is sloping as the soakage trench must be laid level.

Although effective in managing small rainfall events these soakage trenches can quickly become overwhelmed with heavy or persistent rainfall. This necessitates a further overflow connection to a remote centralised storage pond or the intervening storm water network of a town or city. These overflow connections transport the water away from the area where previously it would have soaked directly into the ground over time. Centralised collection installations are also relatively costly solutions in terms of both the land resources required to implement them and their associated construction costs. Furthermore centralised collection installations are in turn prone to saturation and flooding in large-scale weather events when all the excess water from the surrounding district needs to be absorbed at the one site.

It would therefore be advantageous to have improvements with respect to the management, transportation and dispersal of water which could address any or all of the above problems, or at least provide the public with an alternative choice. In particular it would be advantageous to have an improved water conduit which could both transport excess water while also concurrently dispersing water near to its original source.

DISCLOSURE OF THE INVENTION

According to one aspect of the present invention there is provided an adjustable head infiltration conduit configured to distribute water adjacent to the conduit and to convey water away from the conduit, the conduit including, a conveyance chamber defining a water flow path through the conduit, and at least one inlet port associated with one end of the water flow path defined by the conveyance chamber, and at least one outlet port associated with an end of the water flow path distal from said at least one inlet port, and an infiltration chamber in fluid communication with the conveyance chamber, the infiltration chamber including at least one water permeable area configured to allow water out of the conduit, the infiltration chamber also including at least one removable intermediate lateral baffle orientated substantially perpendicular to the water flow path defined by the conveyance chamber with the upper edge of said at least one removable intermediate lateral baffle defining the boundary of the infiltration chamber with the conveyance chamber, wherein the removable intermediate lateral baffle or baffles forming at least two retention cells within the infiltration chamber are arranged to temporarily store water before dispersal through at least one water permeable area of the infiltration chamber, whereby removal or addition of the at least one intermediate lateral baffle adjusts the head of water temporarily stored within the infiltration chamber.

The present invention is arranged to provide an adjustable head infiltration conduit with the capacity to distribute water adjacent to the conduit while also conveying water away from this conduit. It is envisioned that the conduit provided would be buried to a shallow depth, allowing the distributed water to be absorbed into the local water table. It is also envisioned that this conduit would allow for the transportation of excess water to a remote location when this water cannot readily be infiltrated back in to the surrounding area.

Reference in general throughout this specification will be made to a conduit provided by the invention being formed from a single length of material or a single component. However those skilled in the art will appreciate that in various embodiments the conduit provided may have a modular character, allowing separate conduit elements to be connected together to fit the characteristics of an installation site and to provide a water transport mechanism to convey water to a desired remote location. The term conduit is used throughout this specification to identify the individual conduit components arranged for connection together to provide such a facility.

In a preferred embodiment a conduit provided by the invention may be formed from a mouldable settable material such as plastic. In various embodiments the invention may be formed from a small number of inexpensively moulded parts which connect together to provide such a conduit.

A conduit provided by the invention incorporates a conveyance chamber used to define a water flow path to channel water through the conduit. This conveyance chamber can therefore perform the water transportation functions required of the conduit, allowing water to be transported to a remote location.

This conveyance chamber may have any appropriate shape or dimensions which facilitate this transport function, with the exact arrangement employed being dictated by the specific application in which the invention is used.

For example, in one preferred embodiment the conveyance chamber may have a linear form with a curved or hemispherical upper profile. Those skilled in the art will however appreciate that other arrangements of the conveyance chamber are also envisioned for alternative embodiments of the invention. For example in some embodiments a conveyance chamber may not necessarily define a linear flow path, but instead may incorporate or provide a curved form which modifies the direction of travel of water travelling through the water flow path it defines.

The conveyance chamber is also associated with at least one inlet and at least one outlet port. These inlet and outlet ports can be provided at opposite ends of the water flow path of the conveyance chamber to allow water to enter and subsequently exit the conduit. It is envisioned that the conduit may be installed so that the inlet port is positioned at a higher position than the outlet port, allowing a gravity powered fall of water through the conveyance chamber.

Both inlet and outlet ports may define an aperture capable of receiving or emitting water at a desirable flowrate depending on the application in which the invention is used.

In a preferred embodiment an inlet port and/or an outlet port may incorporate an interlocking connector which allows for the engagement of one section conduit with an adjacent section of conduit, and for water to be supplied from one conduit's conveyance chamber to the adjacent conduit's conveyance chamber. For example, in some embodiments the ports of the conduit may have a complimentary male-female character, allowing for a friction fit connection between adjacent conduit components. Alternatively in other embodiments a twist lock connection system such as a bayonet connector may be employed to connect together the adjacent inlet and outlet ports of conduit sections.

Reference throughout this specification will be made to a conveyance chamber including a single outlet port and a single inlet port, each being located at opposite ends of the conveyance chamber. The conveyance chamber will also be referred to as having a substantially linear form in various embodiments. However those skilled in the art will appreciate that other arrangements or configurations of a conduit are envisioned and within the scope of the invention, which may potentially provide curved conduits with two or more inlet ports and two or more outlet ports. For example, in some embodiments an auxiliary inlet port may be formed in the upper surface of the conduit to allow for the supply of water from sources above the conduit.

A conduit provided by the invention also incorporates an infiltration chamber which is in fluid communication with the conveyance chamber. This fluid communication allows water present in the conveyance chamber to enter the infiltration chamber, or for water present in the infiltration chamber to enter the conveyance chamber.

Preferably the conduit provided by the invention may be installed so as to orientate the conveyance chamber above the infiltration chamber. This arrangement will therefore deliver water into the interior of the infiltration chamber first, thereby only allowing water to transit the conveyance chamber once the infiltrated action chamber is filled to capacity.

In a preferred embodiment an entire side or face of the infiltration chamber may be open to an entire side or face of the conveyance chamber. In a further preferred embodiment an infiltration chamber may extend to the same length as the conveyance chamber and the water flow path it defines, with the mating faces or sides of these chambers being open to one another. This arrangement therefore allows for a free flow of water entering the conduit through into the infiltration chamber, and from the infiltration chamber into the conveyance chamber.

The infiltration chamber provided with the invention includes at least one water permeable area which allows water to escape from the interior of the conduit. In a preferred embodiment the infiltration chamber may include a water permeable area on the opposite side of the chamber to its engagement with the conveyance conduit. Once installed this arrangement would preferably position this water permeable area on the underside or bottom surface of the conduit, allowing hydraulic pressure to provide a force which promotes infiltration of the water in the infiltration chamber out into the ground surrounding the conduit.

In additional embodiments more than one area of the infiltration chamber may have a water permeable form, thereby increasing the potential flowrate of water infiltrating the ground adjacent to the conduit. For example in such embodiments the sides of the infiltration chamber may be formed from a water permeable surface in addition to or instead of providing a water permeable base to the infiltration chamber.

Those skilled in the art will appreciate that a water permeable area used in conjunction with the invention may be formed in any way which allows water to exit the conduit. For example in some preferred embodiments a wall, side or the base of the infiltration chamber may be formed from a grid arrangement, allowing water to exit the chamber through the apertures defined in the grid. In yet other embodiments individual holes or apertures may be formed in various surfaces of the infiltration chamber. However in a preferred embodiment a water permeable area may be formed by a void, aperture or space in the materials used to form the main body of the conduit, allowing the free flow of water out of this area of the conduit. For example, in a preferred embodiment the entire base or underside of a conduit may be open to the ground in which the conduit is installed.

An infiltration chamber provided in accordance with the invention also includes at least one removable intermediate lateral baffle which has an orientation substantially perpendicular to the water flow path of the adjacent conveyance chamber. When the conduit is used such a lateral baffle will therefore present a barrier to water attempting to flow through the infiltration chamber from the conduit inlet through to its outlet. This lateral baffle or baffles define at least two retention cells within the infiltration chamber which is used to temporarily store water before dispersal through the water permeable area or areas of this chamber. In this way such a baffle can be described as an intermediate baffle located between the respective terminal end walls of the infiltration chamber.

Each baffle can span the distance between the opposed side walls of the infiltration chamber and can extend from the chamber's water permeable area to an upper edge of the baffle. This upper edge can define a boundary point demarcating the end of the infiltration chamber and start of the conveyance chamber. The distance between this upper edge and the permeable area of the infiltration chamber can therefore be described as the height of the baffle.

The removal or addition of the at least one intermediate lateral baffle adjusts the head of water temporarily stored within the infiltration chamber.

The height of a removable intermediate lateral baffle will determine the volume of water which can be retained within an associated retention cell, and hence the hydraulic head or pressure applied by the weight of this water as experienced at the water permeable area of the infiltration chamber. Reducing the height of a baffle will result in a reduction of this hydraulic head pressure while increasing the relative volume of the adjacent conveyance chamber and hence the flow rate which can be achieved through this chamber. Conversely, increasing the height of a baffle will increase the hydraulic head pressure and therefore the rate of water infiltration out of the infiltration chamber—while reducing the volume of the conveyance chamber and the flow rate available through this chamber.

In a preferred embodiment the adjustable head infiltration conduit includes a plurality of baffles defined with different heights.

Each baffle provided in accordance with the invention has a removable character, meaning that baffles of different heights may be installed within an infiltration conduit depending on the application in which the invention is used and the characteristics of the site at which the invention is used. As the height of each baffle can be used to control the hydraulic head of a particular retention cell, the adjustment of this characteristic can be employed by a user to provide fine control of the hydraulic pressure profile of water along the length of a water transportation and infiltration system. A user may therefore select baffles of specific heights for use at specific places in these systems to control both the flow rate and infiltration rate at these places.

For example at some sites a user may configure the invention to provide for a high infiltration rate and low flow rate. At other sites a balance may be struck between infiltration rate and flow rate, whereas at yet other sites a high flow rate and lower infiltration rate may be desirable. Therefore as an array of infiltration conduits provided by the invention are deployed to run across land with different characteristics the infiltration and flow rate performance of these conduits can be adjusted to suit specific sites.

Furthermore the removable nature of the invention's baffles also allows its infiltration and flow rate performance to be adjusted based on the grade or slope of the ground on which it is installed. As the slope at which the infiltration conduit is installed increases so does the flowrate through the conduit. In such circumstances the infiltration rate exhibited by the conduit can therefore be optimised or increased without necessarily reducing the flow rate available through the conduit.

In a preferred embodiment the infiltration chamber may incorporate a plurality of baffles running the length of this chamber, dividing the infiltration chamber into a plurality of retention cells. One or more of the sides or base of each of these cells may form a water permeable area, allowing water to infiltrate out into the surrounding ground from each retention cell. This array of longitudinally orientated cells will therefore implement a weir effect within the infiltration chamber when the conduit is installed with an angle or sloping orientation which facilitates gravity driven water flows. Each lateral baffle will therefore act as a small dam to retain a fixed volume of water within each retention cell, thereby maximising the volumes of water which can be distributed into the local environment of the conduit.

In a preferred embodiment the ends of a removable intermediate lateral baffle may be received within a pair of opposed complimentary recesses formed in the sidewalls of the infiltration chamber. The complimentary nature of these recesses allow a baffle to be slid into place with the interior of a conduit, and in preferred embodiments locked in place once installed.

For example in one preferred embodiment the sidewalls of the conduit may define an array of projections along the exterior length of the conduit which form paired sets of opposed complimentary recesses within the interior of conduct. In such embodiments a baffle may be slid from the underside of a conduit into its interior, with the complimentary form of these interior recesses guiding the motion of the baffle as its ends contact and slide past the interior surfaces of each complimentary recess.

Furthermore such complimentary recesses may also define at least once locking feature which resists the removal of a baffle once fully inserted into the conduit. Such locking features may—for example—be formed by paired set of male and female projections and recesses in the respective surfaces of each of the ends of the baffles and complimentary recesses which resist further motion of the baffle once features are engaged together.

A conduit provided in accordance with the present invention may provide many potential advantages over the prior art.

Aside from providing an alternative to the use of soakage trenches, the invention allows for the infiltration of water back into the region where this water was collected, in addition to transporting excess water away to a centralised collection point when high water flow rates are experienced.

The invention may be used to replace existing sealed conduits or pipework which function only to transport water to remote sites, allowing this water to be infiltrated into the surrounding ground while being transported to a centralised collection point and controlling the ratio of these two functions. This arrangement mitigates the need for soakage trenches on site at a particular structure while also reducing overall loads on remote centralised water collection systems.

The invention can allow control of the hydraulic head profile along the length of a conduit or series of linked conduits. This arrangement enables the designer to control both the flow rate and the infiltration rate along the length of an entire assembled water infiltration and transportation system.

The invention can also enable infiltration to be achieved at grade and above a shallow ground water level.

The invention may be used to allow for ground water replenishment in constrained applications whether it is land size, ground water level and/or slope of the land that is the constraint.

BRIEF DESCRIPTION OF THE DRAWINGS

Additional and further aspects of the present invention will be apparent to the reader from the following description of an embodiment, given in by way of example only, with reference to the accompanying drawings in which.

Further aspects of the invention will become apparent from the following description of the invention which is given by way of example only of a particular embodiment.

BEST MODES FOR CARRYING OUT THE INVENTION

Figures 1A, 1B, 1C, 1D:
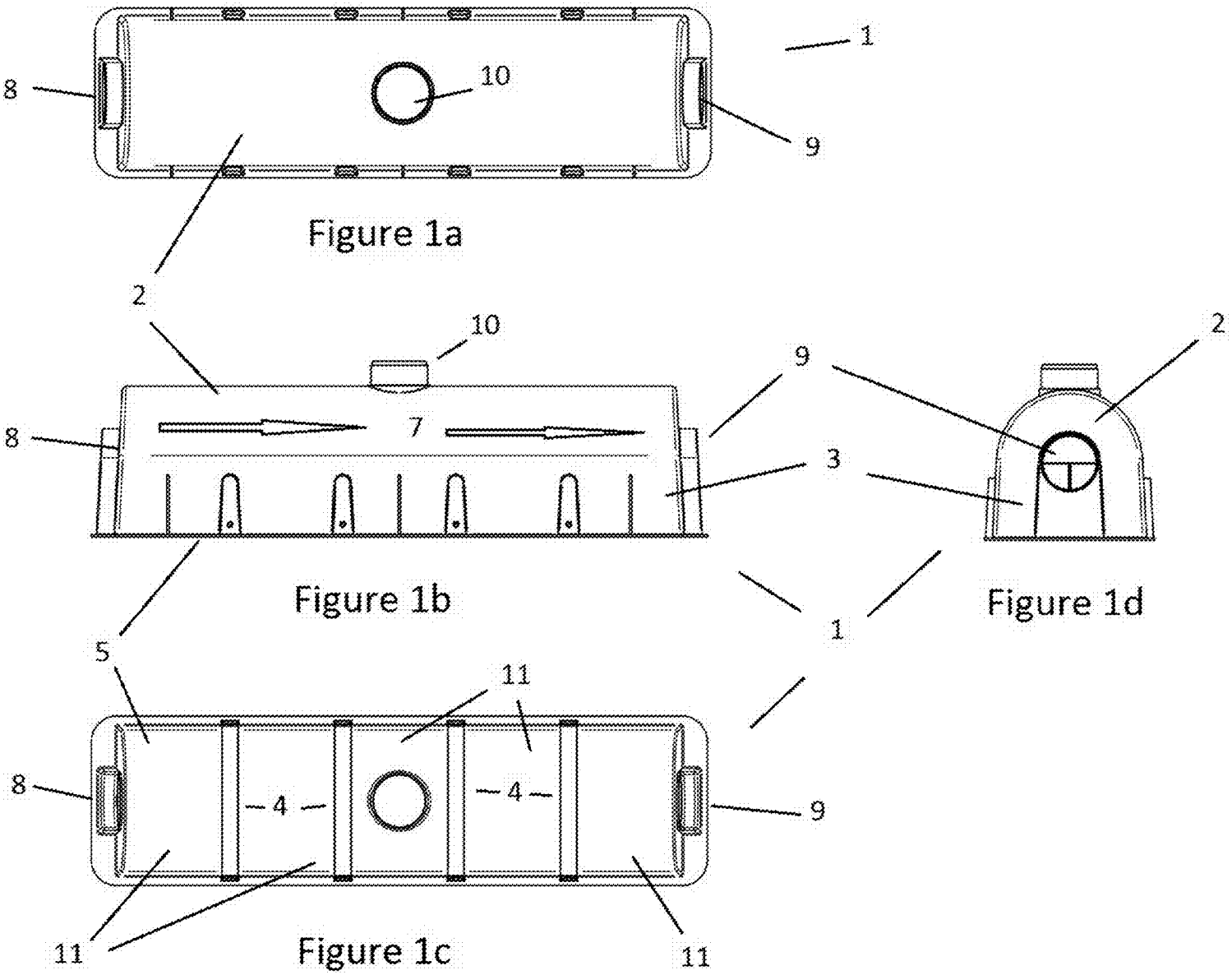
FIGS. 1*a*, 1*b*, 1*c* and 1*d* provide top, side, underside and end views respectively of an adjustable head infiltration conduit as provided in accordance with a preferred embodiment, FIG. 2*a* provides a perspective view of the conduit of FIGS. 1*a*-1*d* while FIGS. 2*b* and 2*c* provide perspective and end views of the same conduit with the exterior of the conduit shown in ghosted outline, FIG. 3*a* provides a perspective view of a portion of a water transport and infiltration system formed by interconnecting multiple conduits as illustrated by FIGS. 1*a-d* and 2*a-c*, while FIG. 3*b* provides the same view with the exterior of the conduits shown in ghosted outline, FIGS. 4*a*, 4*b* and 4*c* provide perspective, side and end views illustrating how the conduits illustrated with respect to FIGS. 3*a* and 3*b* can be can be stacked inside each other for transportation and storage, FIGS. 5*a*, 5*b* and 5*c* provide a sequence of comparison views of various removable intermediate lateral baffles of differing heights which can be used in various embodiments of the invention, and FIG. 6*a*, 6*b* provide plan views of a baffle which is used to engage with a conduit in accordance with a further embodiment of the invention.
Figure 2A:
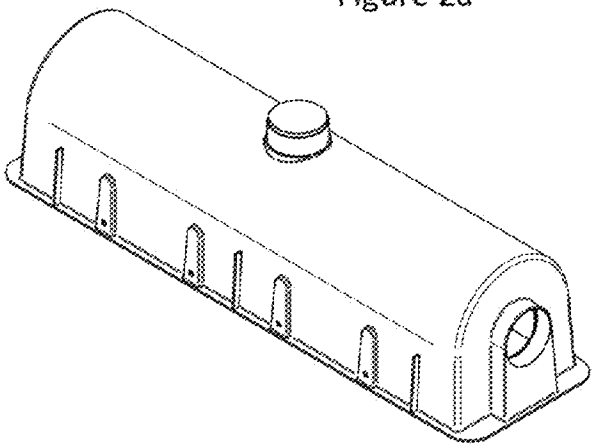
Figure 2C:
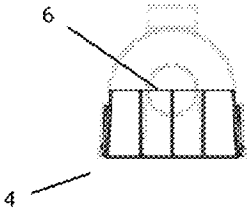
Figure 2B:
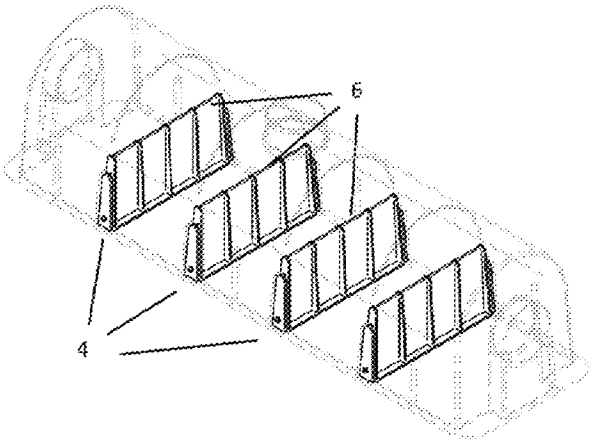

FIGS. 1*a*, 1*b*, 1*c* and 1*d* provide top, side, underside and end views respectively of an adjustable head infiltration conduit 1 as provided in accordance with a preferred embodiment. FIG. 2*a* also provides a perspective view of the conduit of FIGS. 1*a*-1*d* while FIGS. 2*b* and 2*c* provide perspective and end views of the same conduit with the exterior of the conduit shown in ghosted outline.

These figures show the provision of an adjustable head infiltration conduit 1 formed with an upper conveyance chamber 2 and a lower infiltration chamber 3. The conduit is designed to both distribute water adjacent to the conduit and to convey water away from the conduit.

In the embodiment shown the infiltration chamber 3 contains four removable intermediate lateral baffles 4. These baffles 4 extend from a water permeable base 5 of the conduit to an upper edge 6 of each baffle which defines the boundary between infiltration chamber 3 and conveyance chamber 2. Water permeability is provided by the base of the conduit being open to the surrounding ground in the embodiment shown.

As can be seen from these figures the infiltration and conveyance chambers are open to one another at their upper and lower boundaries respectively, allowing for the free flow of water between these two chambers.

The conveyance chamber defines a water flow path 7 through the conduit which runs from a primary inlet port 8 to an outlet port 9. An auxiliary inlet port 10 is also formed in the upper surface of the conduit to allow for the supply of water from sources above the conduit.

The four removable intermediate lateral baffles divide the infiltration chamber into five separate retention cells 11, with this array of cells being bounded at either end of the conduit by its end walls. These retention cells temporarily store water and will allow it to be dispersed out into the surrounding ground through the permeable base of the conduit.

FIGS. 2*b* and 2*c* show in more detail the configuration and use of the lateral baffles 4 which form the array of retention cells. Each of these baffles is orientated substantially perpendicular to the water flow path defined by the conveyance chamber, with each baffle spanning the distance between the adjacent sidewalls of the conduit. As can be seen from FIG. 2*c* the height of the baffles will control the available volume within a retention cell 11, and hence the hydraulic head pressure experienced at the water permeable base of the conduit. Reducing the height of the baffle will increase the relative volume of the adjacent conveyance chamber at the expense of available hydraulic head pressure and hence the rate of water infiltration out of a retention cell. Conversely increases in the height of the baffle will increase water infiltration rates due to an increase in hydraulic pressure at the expense of water flow rate through the conveyance chamber.

The height of a baffle can also be selected to control the relative flow and infiltration rates depending on the gradient or slope at which the conduit is installed in the ground. For example a relatively high baffle may be provided at steep installation grades where gravity will increase the flow rate through the conveyance chamber, allowing infiltration rates to also be increased.

Figures 3A, 3B:
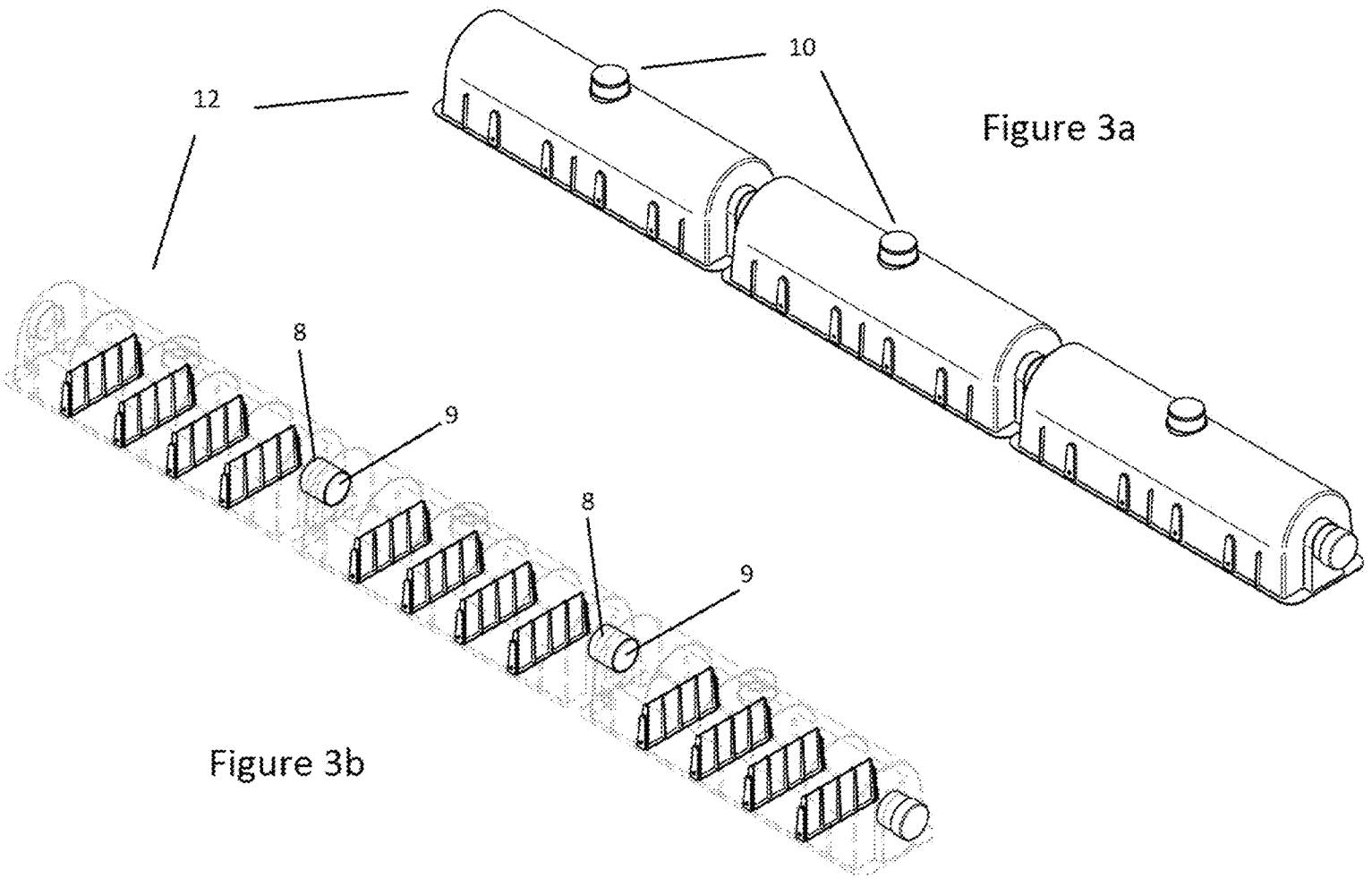

FIG. 3*a* provides a perspective view of a portion of a water transport and infiltration system 12 formed by interconnecting multiple conduits 1 as illustrated by FIGS. 1*a*-*d* and 2*a*-*c*, while FIG. 3*b* provides the same view with the exterior of the conduits shown in ghosted outline.

FIGS. 3*a* and 3*b* show how the invention can be used both convey water to a remote location while also infiltrating water into the ground along the length of the transportation system formed. A sequence of infiltration conduits may be connected via outlet 9 and primary inlet ports 8 to form the system, with auxiliary inlet ports 10 also allowing for connections to be made to additional water sources above each of the conduits.

The removable nature of each of the lateral baffles ensures that the hydraulic head experienced in each retention cell can be controlled to adjust the relative ratio of infiltration rate and flow rate at the specific sites or locations traversed by the system 12. Those skilled in the art will appreciate that a single conduit may integrate baffles of different heights to that of an adjacent or remote conduit in same system—or potentially may incorporate a set of baffles with different heights within the same conduit.

During installation a decision can be made as to the infiltration and flow rates required from a specific conduit and the appropriate baffles can then be installed in the conduit prior to the conduit being installed in the ground.

Figure 4C:
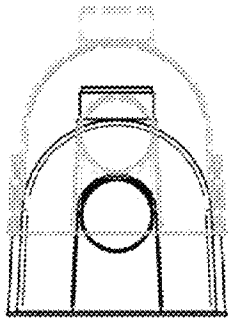
Figure 4A:
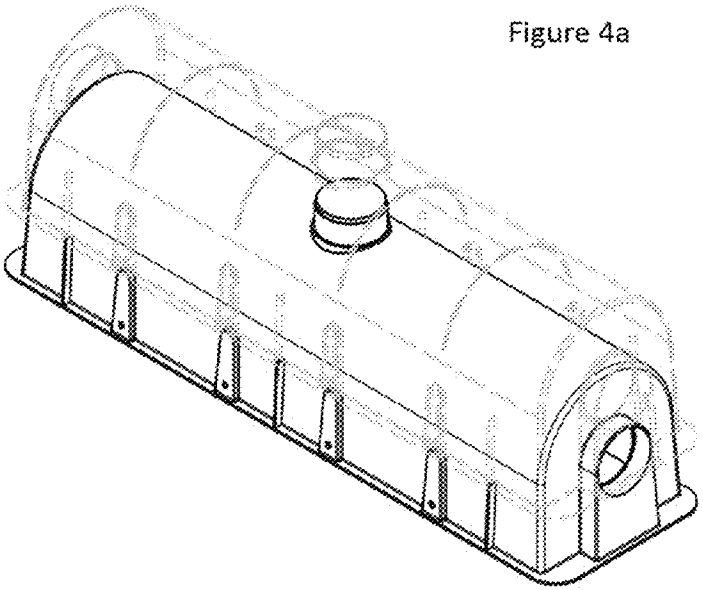
Figure 4B:
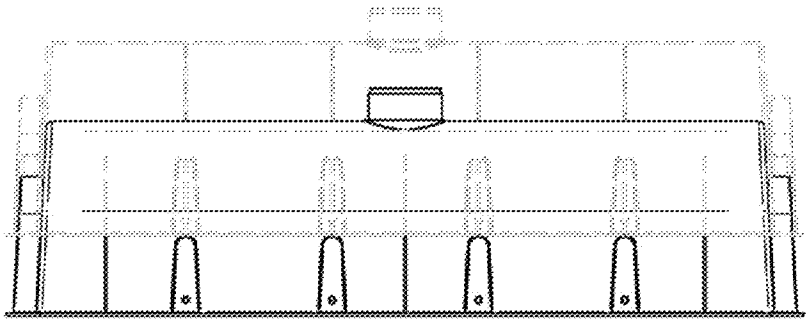

FIGS. 4*a*, 4*b* and 4*c* provide perspective, side and end views illustrating how the conduits illustrated with respect to FIGS. 3*a* and 3*b* can be stacked inside each other for transportation and storage. In preferred embodiments the water permeable base of each conduit may be open to the surrounding ground, allowing a series of conduits to be nested or stacked inside one another if their removable baffles are not installed.

Figure 5A:
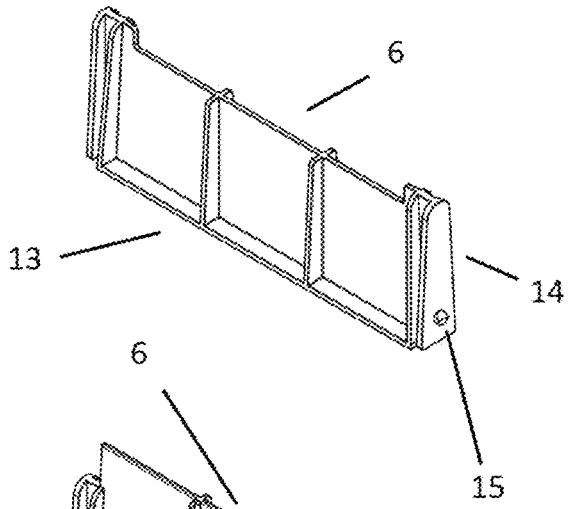
Figure 5B:
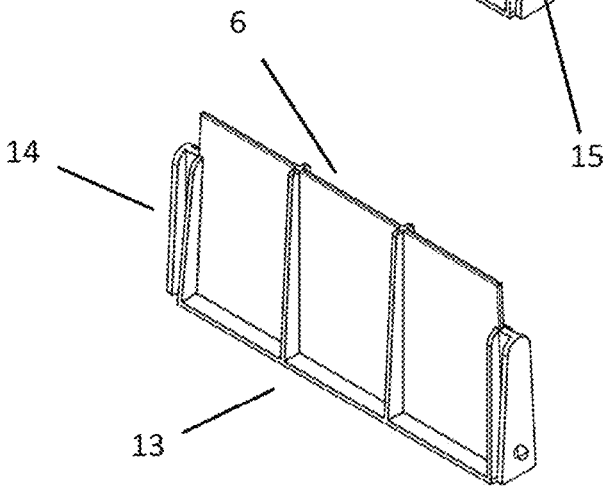
Figure 5C:
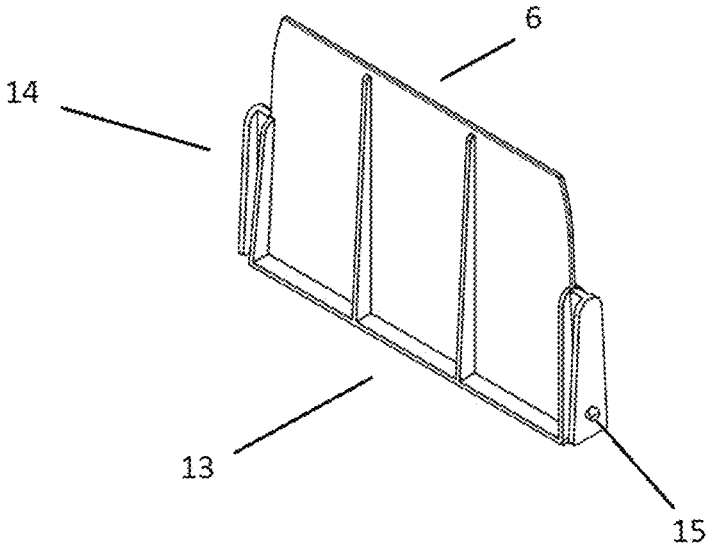

FIGS. 5*a*, 5*b* and 5*c* provide a sequence of comparison views of various removable intermediate lateral baffles of differing heights which can be used in various embodiments of the invention.

As can be seen from these figures the height of each baffle may be defined by the distance between its upper exposed edge 6 and its opposite lower edge 13 deployed at the base of the conduit.

As can be seen from FIGS. 5*a*, 5*b* and 5*c* the size of the step formed by each baffle can vary depending on the effective height required for a baffle.

These figures also illustrate additional features of the baffle 4 used to facilitate a connection being made with the conduit. In particular each end of the baffle defines a 'T" profile form 14 in addition to a locking projection 15. The T profile end form of the baffle cooperates with a complimentary recess defined in the side wall of the conduit to guide the motion of the baffle into the interior of the conduit. The locking projection 15 mates with a complimentary receiver formed in the side wall of the conduit to secure the baffle in place within the conduit at a desired position.

Figure 6A:
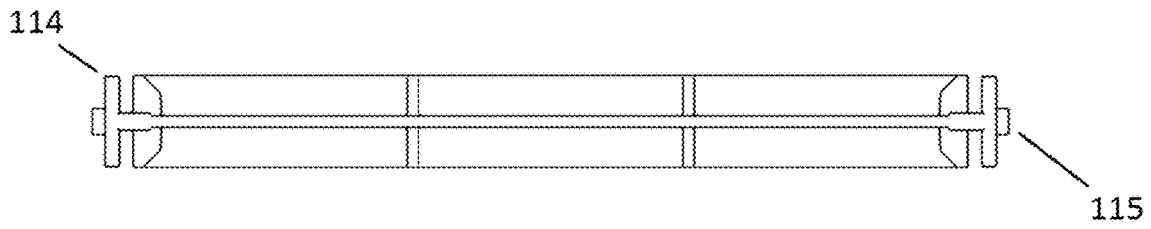
Figure 6B:
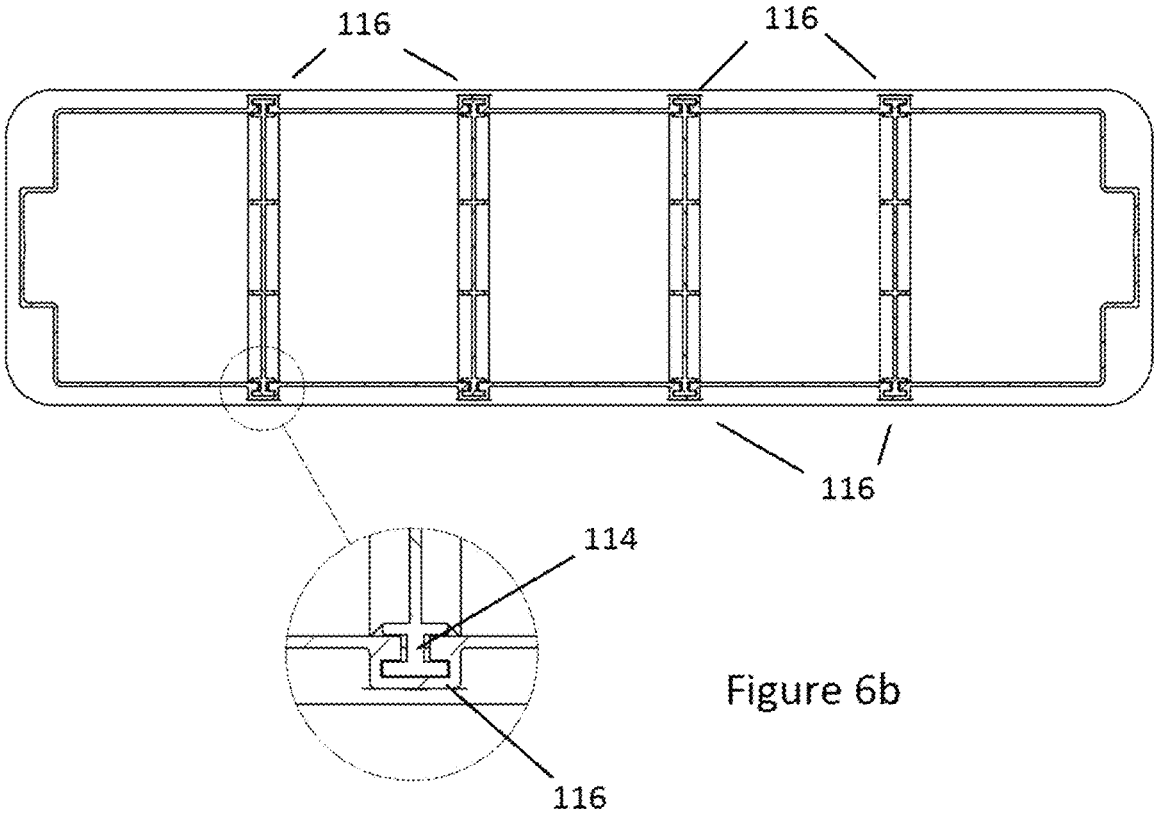

FIG. 6*a*, 6*b* provide plan views of a baffle which is used to engage with a conduit in accordance with a further embodiment of the invention.

Again in the embodiment shown the ends of each baffle have a 'T" profile form 114 and also define a locking projection 115. The sidewalls of the conduit define an array of opposed pairs of complimentary recesses 116 which are used to receive the ends of each baffle. As shown in the enlargement view provided these recesses have complimentary form to the end of each baffle and are used to guide the motion of the baffle into the interior of the conduit.

In the preceding description and the following claims the word "comprise" or equivalent variations thereof is used in an inclusive sense to specify the presence of the stated feature or features. This term does not preclude the presence or addition of further features in various embodiments.

It is to be understood that the present invention is not limited to the embodiments described herein and further and additional embodiments within the spirit and scope of the invention will be apparent to the skilled reader from the examples illustrated with reference to the drawings. In particular, the invention may reside in any combination of features described herein, or may reside in alternative embodiments or combinations of these features with known equivalents to given features. Modifications and variations of the example embodiments of the invention discussed above will be apparent to those skilled in the art and may be made without departure of the scope of the invention as defined in the appended claims.

I claim:

1. An adjustable head infiltration conduit configured to distribute water adjacent to the conduit and to convey water away from the conduit, the conduit comprising a conveyance chamber defining a water flow path through the conduit, at least one inlet port associated with one end of the water flow path defined by the conveyance chamber, at least one outlet port associated with an end of the water flow path distal from said at least one inlet port, and an infiltration chamber in fluid communication with the conveyance chamber, the infiltration chamber including at least one water permeable area configured to allow water out of the conduit, the infiltration chamber also including at least one removable intermediate lateral baffle orientated substantially perpendicular to the water flow path defined by the conveyance chamber with the upper edge of said at least one removable intermediate lateral baffle defining the boundary of the infiltration chamber with the conveyance chamber, the removable intermediate lateral baffle or baffles forming at least two retention cells within the infiltration chamber being arranged to temporarily store water before dispersal through at least one water permeable surface of the infiltration chamber, whereby removal or addition of the at least one intermediate lateral baffle adjusts the head of water temporarily stored within the infiltration chamber, the ends of said at least one removable intermediate lateral baffle being received within a pair of opposed complimentary recesses formed in the sidewalls of the infiltration chamber.

2. The adjustable head infiltration conduit as claimed in claim 1 formed from a mouldable settable material.

3. The adjustable head infiltration conduit as claimed in claim 1 wherein said at least one inlet and outlet ports are provided at opposite ends of the water flow path of the conveyance chamber.

4. The adjustable head infiltration conduit as claimed in claim 1 which defines a linear water flow path.

5. The adjustable head infiltration conduit as claimed in claim 1 wherein the conveyance chamber is positioned and orientated above the infiltration chamber.

6. The adjustable head infiltration conduit as claimed in claim 1 wherein one side or face of the conveyance chamber is open to one side or face of the infiltration chamber.

7. The adjustable head infiltration conduit as claimed in claim 1 wherein said at least one removal intermediate lateral baffle spans the distance between the opposed side walls of the infiltration chamber and extends from the chamber's water permeable area to an upper edge of the baffle, said upper edge defining a boundary demarcating the end of the infiltration chamber and start of the conveyance chamber.

8. The adjustable head infiltration conduit as claimed in claim 7 which incorporates a plurality of removal intermediate lateral baffles running the length of the infiltration chamber which divide the infiltration chamber into a plurality of retention cells.

9. The adjustable head infiltration conduit as claimed in claim 8 which includes a plurality of baffles defined with different heights.

10. The adjustable head infiltration conduit as claimed in claim 1 wherein the sidewalls of the conduit define an array of projections along the exterior length of the conduit which form paired sets of opposed complimentary recesses.

11. The adjustable head infiltration conduit as claimed in claim 10 wherein said at least one removable intermediate lateral baffle is inserted into the infiltration chamber by being slid from the underside of a conduit into the interior of the infiltration chamber with the complimentary interior recesses guiding the motion of the baffle.

12. The adjustable head infiltration conduit as claimed in claim 1 wherein said at least one removable intermediate lateral baffle is inserted into the infiltration chamber by being slid from the underside of a conduit into the interior of the infiltration chamber with the complimentary interior recesses guiding the motion of the baffle.

13. The adjustable head infiltration conduit as claimed in claim 1 wherein the complimentary recesses defines at least once locking feature which resists the removal of a baffle once fully inserted into the conduit.

14. The adjustable head infiltration conduit as claimed in claim 13 wherein said at least one locking feature is formed by paired set of male and female projections and recesses in the respective surfaces of each of the ends of the baffles and complimentary recesses.

15. The adjustable head infiltration conduit as claimed in claim 1 which incorporates a single inlet and a single outlet.

16. The adjustable head infiltration conduit as claimed in claim 1 wherein an inlet or outlet port incorporates an interlocking connector configured to engage the conduit with an adjacent conduit.

17. An adjustable head infiltration conduit configured to distribute water adjacent to the conduit and to convey water away from the conduit, the conduit comprising a conveyance chamber defining a water flow path through the conduit, at least one inlet port associated with one end of the water flow path defined by the conveyance chamber, at least one outlet port associated with an end of the water flow path distal from said at least one inlet port, an infiltration chamber in fluid communication with the conveyance chamber, the infiltration chamber including at least one water permeable area configured to allow water out of the conduit, the infiltration chamber also including at least one removable intermediate lateral baffle orientated substantially perpendicular to the water flow path defined by the conveyance chamber with the upper edge of said at least one removable intermediate lateral baffle defining the boundary of the infiltration chamber with the conveyance chamber, the removable intermediate lateral baffle or baffles forming at least two retention cells within the infiltration chamber are arranged to temporarily store water before dispersal through at least one water permeable surface of the infiltration chamber, whereby removal or addition of the at least one intermediate lateral baffle adjusts the head of water temporarily stored within the infiltration chamber, said at least one removable intermediate lateral baffle spanning the distance between the opposed side walls of the infiltration chamber and extends from the chamber's water permeable area to an upper edge of the baffle, said upper edge defining a boundary demarcating the end of the infiltration chamber and start of the conveyance chamber, a plurality of removable intermediate lateral baffles running the length of the infiltration chamber which divide the infiltration chamber into a plurality of retention cells, and a plurality of baffles defined with different heights.

* * * * *